US007663575B2

(12) United States Patent
Choi et al.

(10) Patent No.: US 7,663,575 B2
(45) Date of Patent: Feb. 16, 2010

(54) DRIVING CIRCUIT FOR DRIVING ORGANIC ELECTROLUMINESCENT ELEMENT, DISPLAY PANEL AND DISPLAY APPARATUS HAVING THE SAME

(75) Inventors: Joon-Hoo Choi, Seoul (KR); In-Su Joo, Seongnam-si (KR); Beohm-Rock Choi, Seoul (KR); Jong-Moo Huh, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 617 days.

(21) Appl. No.: 10/865,066

(22) Filed: Jun. 10, 2004

(65) Prior Publication Data

US 2004/0251846 A1 Dec. 16, 2004

(30) Foreign Application Priority Data

Jun. 12, 2003 (KR) ..... 10-2003-0037834

(51) Int. Cl.
*G09G 3/30* (2006.01)
*G09G 3/10* (2006.01)

(52) U.S. Cl. ..... 345/76; 315/169.3

(58) Field of Classification Search ..... 345/76, 345/79, 82, 83; 315/169.3
See application file for complete search history.

(56) References Cited

U.S. PATENT DOCUMENTS 6,229,506 B1 * 5/2001 Dawson et al. ..... 345/82
6,680,580 B1 * 1/2004 Sung ..... 315/169.3
2003/0052843 A1 * 3/2003 Yamazaki et al. ..... 345/82
2003/0111966 A1 * 6/2003 Mikami et al. ..... 315/169.3

FOREIGN PATENT DOCUMENTS

CN 1427388 7/2003

OTHER PUBLICATIONS

Office Action from the Patent Office of the People's Republic of China dated Jan. 25, 2008.

* cited by examiner

*Primary Examiner*—Amr Awad
*Assistant Examiner*—Randal Willis
(74) *Attorney, Agent, or Firm*—F. Chau & Associates, LLC

(57) ABSTRACT

A driving circuit for an organic light emitting display apparatus includes first and second switching elements and a driving element. The first switching element is controlled by a scan signal supplied from a scan line. The second switching element is controlled by the scan signal. The driving element provides an end of an organic electroluminescent element with a first reference voltage via the second switching element. The driving element has amorphous silicon thin film transistors so that the manufacturing cost of the organic light emitting display apparatus may be reduced.

28 Claims, 5 Drawing Sheets

DRIVING CIRCUIT FOR DRIVING ORGANIC ELECTROLUMINESCENT ELEMENT, DISPLAY PANEL AND DISPLAY APPARATUS HAVING THE SAME

CROSS-REFERENCE TO RELATED APPLICATIONS

This application claims priority upon Korean Patent Application No. 2003-37834 filed on Jun. 12, 2003, the contents of which are herein incorporated by reference in its entirety.

BACKGROUND OF THE INVENTION

1. Field of the Invention

The present invention relates to a driving circuit for an organic light emitting display apparatus, a display panel having the driving circuit and a display apparatus having the driving circuit.

2. Description of the Related Art

Flat display apparatuses such as organic light emitting display (OLED) apparatus have low cost, thin thickness, light weight and so on have been developed.

The OLED apparatus does not require a backlight assembly so that the OLED apparatus has thinner thickness and lighter weight compared with a liquid crystal display (LCD) apparatus. The OLED apparatus may be manufactured by lower cost compared with the LCD apparatus. Furthermore, the OLED apparatus has wider viewing angle and higher luminance compared with the LCD apparatus. The OLED apparatus displays an image using light generated by an organic electroluminescent element. When an electric energy is applied to the organic electroluminescent element, light is generated from the organic electroluminescent element.

The OLED apparatus is classified into an active-matrix type OLED apparatus and a passive-matrix type OLED apparatus. The active-matrix type OLED apparatus includes a switching element corresponding to a unit pixel of the OLED panel.

The unit pixel of a conventional active-matrix type OLED apparatus includes a switching transistor (QS), a driving transistor (QD), a storage capacitor (CST) and the organic electroluminescent element (EL).

In general, brightness of the OLED apparatus is lower than that of a cathode ray tube (CRT) apparatus. The active-matrix type OLED apparatus, however, has brightness higher than that of the passive-matrix type OLED apparatus. An amount of the light generated from the organic electroluminescent element increases in proportion to a current density of the current applied to the organic electroluminescent element.

A hydrogenated amorphous silicon transistor (a-Si:H) has a mobility lower than that of a poly silicon (Poly-Si) transistor. In addition, the amorphous silicon transistor generally does not employ a p-type transistor because it is difficult to form the amorphous silicon transistor using the p-type transistor. Furthermore, the amorphous silicon transistor has a unstable bias stability. Therefore, the OLED apparatus generally employs the poly silicon (Poly-Si) transistor rather than the amorphous silicon transistor. The poly silicon transistor, however, is more expensive than the amorphous silicon transistor.

When a driving circuit for driving the electroluminescent (EL) element has the amorphous silicon transistor, the driving circuit employs only an n-type transistor. When an OLED apparatus such as the active-matrix type OLED apparatus displays the image using the current, the current flowing through the electroluminescent (EL) element is controlled so as to express gray scales of the image.

A channel conductance corresponding to a gate-source voltage (Vgs) of the driving transistor (QD) is controlled in response to a data signal that is applied to a gate electrode of the driving transistor (QD) so as to control the current flowing through the electroluminescent (EL) element in response to the data signal that is provided from external image source to the OLED apparatus. The electroluminescent (EL) element is electrically connected to a thin film transistor (TFT) (or a driving transistor (QD)) in series.

When the OLED apparatus includes the p-type transistor as the driving transistor (QD), the electrode, of the driving transistor (QD), connected to a bias voltage line functions as a source electrode since the bias voltage line has a high voltage, and a size of the gate-source voltage (Vgs) between the gate electrode of the driving transistor (QD) and the source electrode of the driving transistor (QD) is determined by a voltage that is applied to the gate electrode of the driving transistor (QD) via a data line (DLn).

When the OLED apparatus includes the n-type transistor as the driving transistor (QD), the electrode, of the driving transistor (QD), connected to the electroluminescent (EL) element functions as the source electrode so that a voltage applied to a node (N1) that is electrically connected to the driving transistor (QD) and the electroluminescent (EL) element may be unstable. The voltage applied to the node (N1) may be changed in response to the data voltage signal corresponding to a previous frame. In addition, a dynamic range of the gate-source voltage between the gate electrode of the driving transistor (QD) and the source electrode of the driving transistor (QD) is narrower than the dynamic range of the data voltage signal that is provided from external image source.

Therefore, the driving transistor (QD) of the OLED panel generally employs the p-type transistor instead of the n-type transistor.

SUMMARY OF THE INVENTION

The present invention provides a driving circuit for driving an organic electroluminescent element that employs an n-type amorphous-silicon transistor so as to reduce a manufacturing cost.

The present invention also provides an organic light emitting display panel including the driving circuit.

The present invention also provides an organic light emitting display apparatus having the driving circuit.

In some exemplary embodiments, a driving circuit for driving an organic electroluminescent element includes a first switching element, a second switching element and a driving element. The first switching element is configured to be controlled by a scan signal provided from a scan line. The second switching element is configured to be controlled by the scan signal. The driving element is configured to provide an end of the organic electroluminescent element with a first reference voltage via the second switching element. In another exemplary embodiments, a driving circuit for controlling a current applied to an organic electroluminescent element includes a storage capacitor, a first switching element, a second switching element, and a driving element. The first switching element is configured to provide a first end of the storage capacitor with the data signal supplied from a data line in response to a scan signal supplied from a scan line. The second switching element is configured to provide a second end of the storage capacitor with a first reference voltage in response to the scan signal. The driving element is configured to provide the organic electroluminescent element with the current by controlling a level of a bias voltage in response to a voltage charged at the storage capacitor so that the organic electroluminescent element generates a light based on the current. The first and second switching elements may be amorphous-silicon thin film transistors, respectively.

In still another exemplary embodiments, a driving circuit for controlling a current applied to an organic electroluminescent element includes a first switching element, a second switching element, a storage capacitor, a first driving element and a second driving element. The first switching element is configured to output a data signal supplied from a data line in response to a scan signal supplied from a scan line, and the data signal corresponds to a gray scale voltage. The second switching element is configured to output a first reference voltage supplied from a first reference voltage line in response to the scan signal. The storage capacitor is configured to store a first voltage corresponding to a voltage difference between the data signal and the first reference voltage. The first driving element is configure to output a bias voltage supplied from a bias voltage line in response to an inversion signal that has a substantially inverted phase with respect to the scan signal. The second driving element is configured to control a level of the bias voltage based on the first voltage to provide the organic electroluminescent element with the current having a level corresponding to the first voltage.

In still another exemplary embodiments, a driving circuit for controlling a current applied to an organic electroluminescent element includes a first switching element, a second switching element, a storage capacitor, a first driving element and a second driving element. The first switching element includes a first electrode electrically coupled to a data line that transfers a data signal, a second electrode electrically coupled to a scan line that transfers a scan signal and a third electrode. The first switching element outputs the data signal via the third electrode in response to the scan signal. The second switching element includes a fourth electrode and a fifth electrode, the fourth electrode electrically coupled to the scan line and the second electrode of the first switching element, a fifth electrode electrically coupled to a first reference voltage line that transfers the first reference voltage. The storage capacitor includes a first end and a second end. The first end is electrically coupled to the third electrode of the first switching element, the second end is electrically coupled to the sixth electrode of the second switching element, and the storage capacitor stores a first voltage corresponding to a voltage difference between the data signal and the first reference voltage. The first driving element includes a seventh electrode and an eighth electrode. The seventh electrode is electrically coupled to a bias voltage line that transfers a bias voltage, and the eighth electrode is electrically coupled to a control line. The second driving element includes tenth, eleventh and twelfth electrodes. The tenth electrode is electrically coupled to the ninth electrode of the first driving element, the eleventh electrode is electrically coupled to the first end of the storage capacitor, and the twelfth electrode provides the current to the organic electroluminescent element via the twelfth electrode. The current has a level corresponding to the first voltage. The first and second switching elements, and the first and second driving elements may be amorphous silicon thin film transistors, respectively.

In still another exemplary embodiments, an organic light emitting display panel includes a data line, a bias voltage line, a scan line, a control line, and a driving circuit. The data line transfers a data signal corresponding to a gray scale data therethrough. The bias voltage line transfers a bias voltage therethrough. The scan line transfers a scan signal therethrough. The control line transfers an inversion signal having an substantially inverted phase with respect to the scan signal therethrough. The driving circuit is formed in a region defined by the data and scan lines to provide an organic electroluminescent element with a current corresponding to the data signal by controlling a bias voltage in response to the data signal when the scan line is activated. The driving circuit includes an amorphous silicon transistor.

In still another exemplary embodiments, an organic light emitting display apparatus includes a timing controller, a data driver, a scan driver, an organic light emitting display panel, and a power supply. The timing controller is configured to output a second image signal and first, second and third timing signals in response to a first image signal and a control signal. The data driver is configured to output a data signal in response to the second image signal and the first timing signal. The scan driver is configured to output a scan signal in response to the second timing signal. The organic light emitting display panel includes a plurality of data lines respectively transferring the data signal, a plurality of scan lines respectively transferring the scan signal, and a plurality of driving circuit respectively formed in a region defined by the data and scan lines. Each of the driving circuits includes a plurality of amorphous silicon thin film transistors. Each of the driving circuits is configured to provide an organic electroluminescent element with a current in response to the scan signal by controlling the current based on the data signal and a bias voltage, so that the organic light emitting display panel displays an image. The power supply is configured to output a gate on/off voltage to the scan driver in response to the third timing signal, and configured to output the bias voltage, a first reference voltage and a second reference voltage to the organic light emitting display panel.

The organic electroluminescent driving circuit of the organic light emitting display panel includes the driving element having the amorphous silicon thin film transistor so that the manufacturing cost of the organic light emitting display apparatus may be reduced.

BRIEF DESCRIPTION OF THE DRAWINGS

The above and other features and advantage points of the present invention will become more apparent by describing in detailed exemplary embodiments thereof with reference to the accompanying drawings, in which.

DETAILED DESCRIPTION OF INVENTION

Hereinafter, the preferred embodiment of the present invention will be described in detail with reference to the accompanied drawings.

Figure 1:
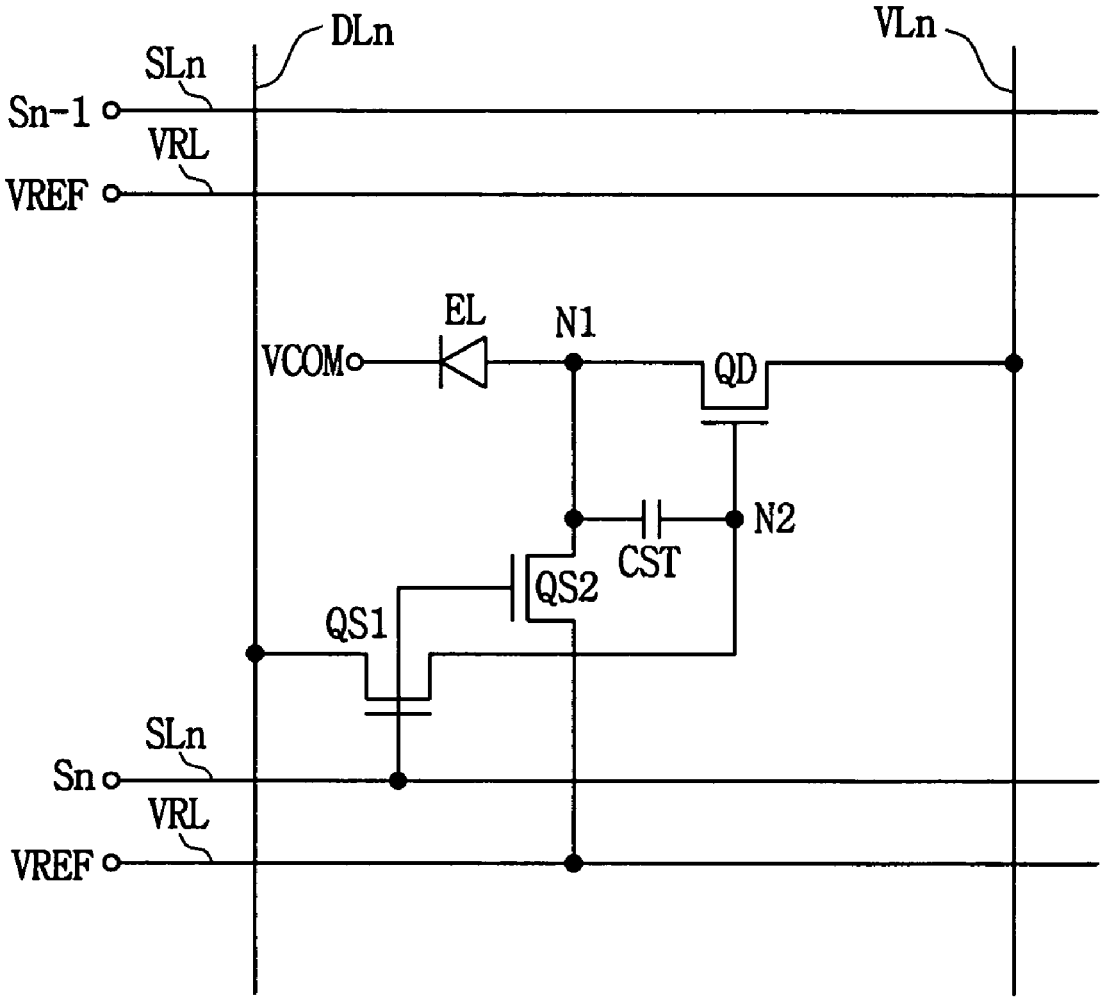
FIG. 1 is a circuit diagram showing a unit pixel of an organic light emitting display apparatus according to an exemplary embodiment of the present invention.

FIG. 1 is a circuit diagram showing a unit pixel of an organic light emitting display apparatus according to an exemplary embodiment of the present invention. FIG. 1 shows a unit pixel of an active-matrix type of organic light emitting display apparatus.

Referring to FIG. 1, a driving circuit for driving an organic electroluminescent element (EL) includes a first switching transistor (QS1), a second switching transistor (QS2), a storage capacitor (CST) and a driving transistor (QD), which are formed on a region defined by a data line (DLn) transferring a data signal therethrough, scan lines (SLn, SLn−1) transferring a scan signal therethrough and a bias voltage line (VLn) transferring a bias voltage (VDD) therethrough. The driving circuit controls a current applied to the organic electroluminescent element (EL).

The first and the second switching transistors QS1 and QS2 respectively include amorphous silicon thin film transistors (a-Si TFT). The first and second switching transistors QS1 and QS2 include N-channel metal oxide semiconductor (NMOS) transistors. The driving transistor (QD) may also include amorphous-silicon thin film transistors of the NMOS transistors.

A source electrode of the first switching transistor (QS1) is electrically connected to the data line (DLn), and a gate electrode thereof is electrically connected to the scan line (SLn). The first switching transistor (QS1) outputs the data signal via a drain electrode thereof in response to the scan signal.

A gate electrode of the second switching transistor (QS2) is electrically connected to the scan line (SLn) and the gate electrode of the first switching transistor (QS1). A source electrode of the second switching transistor (QS2) is electrically connected to a reference voltage line (VRL) transferring a reference voltage (VREF) therethrough. The second switching transistor (QS2) controls an output of the reference voltage (VREF) in response to the scan signal. The reference voltage (VREF) may be provided from an external power source. Alternatively, a ground voltage or a common voltage (VCOM) coupled to the organic electroluminescent element (EL) may be used as the reference voltage (VREF).

A first end of the storage capacitor (CST) is electrically connected to the drain electrode of the first switching transistor (QS1), and a second end of the storage capacitor (CST) is electrically connected to the drain electrode of the second switching transistor (QS2). The storage capacitor (CST) stores electric charges formed by a data signal that is applied to the first end of the storage capacitor (CST) via the first switching transistor (QS1). In particular, the data signal substantially corresponds to an electric potential difference between the reference voltage VREF, which is applied to the second end of the storage capacitor (CST) via the second switching transistor (QS2), and a data voltage signal, which is applied to the first end of the storage capacitor (CST) via the first switching transistor (QS1). Namely, the data signal corresponds to the electric potential difference between nodes N1 and N2.

A drain electrode of the driving transistor (QD) is electrically connected to the bias voltage line (VLn). A gate electrode of the driving transistor (QD) is electrically connected to the first end of the storage capacitor (CST). A source electrode of the driving transistor (QD) is electrically connected to the organic electroluminescent element (EL).

When the scan signal having a high level is applied to the scan line (SLn), the first and second switching transistors (QS1 and QS2) are turned on. When the first and second switching transistors (QS1 and QS2) are turned on, the data voltage signal is applied to the gate electrode of the driving transistor (QD) via the first switching transistors (QS1).

The reference voltage (VREF) is applied to the source electrode of the driving transistor (QD). The electric charges formed by the gate-source voltage (Vgs), which corresponds to the electric potential difference between the nodes N1 and N2., are stored in the storage capacitor (CST) so that the storage capacitor (CST) provides the organic electroluminescent element, which displays an image during a frame, with a current. The level of the current varies based on the variation of the data signal. When the current is applied to the organic electroluminescent element (EL), light is generated.

Figure 2:
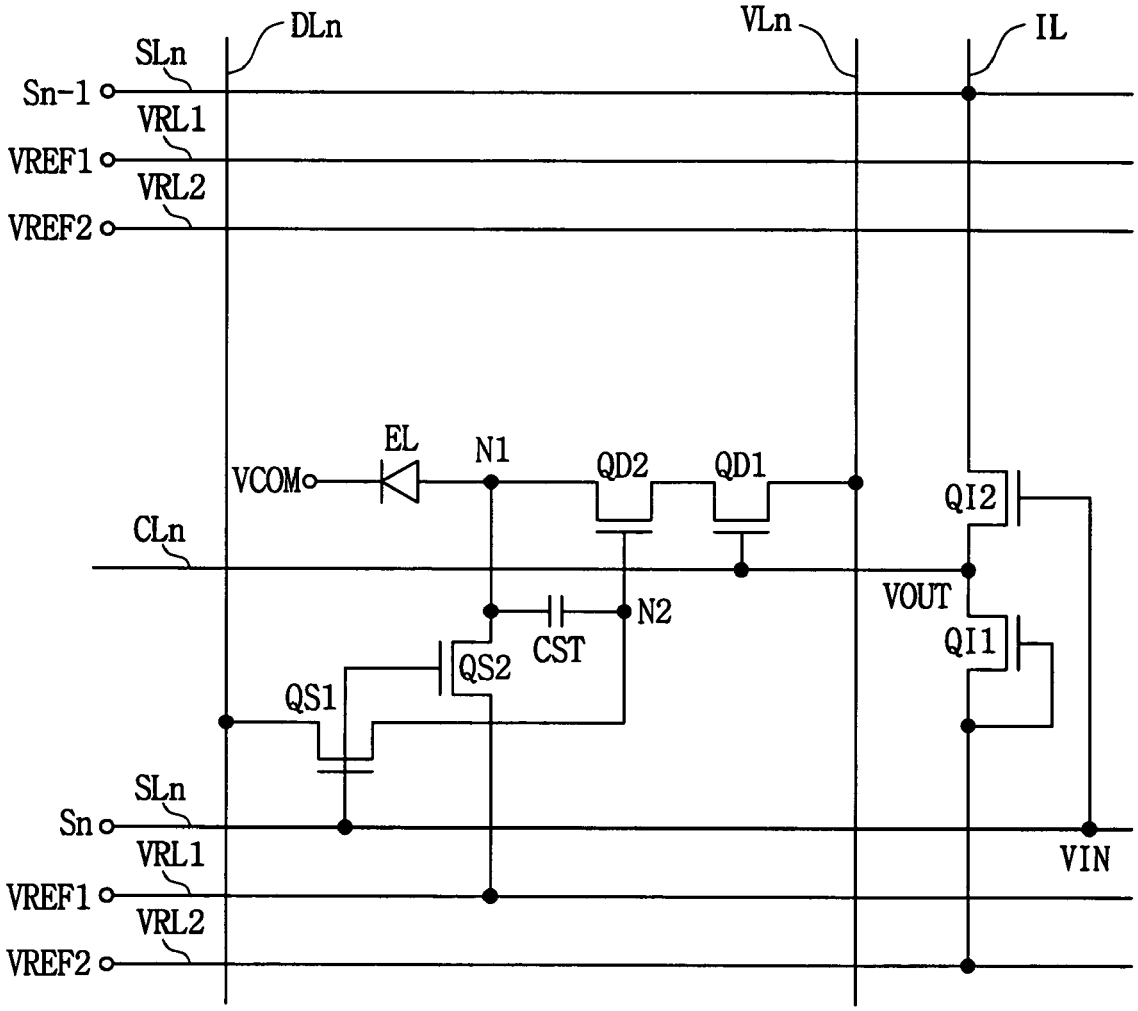
FIG. 2 is a circuit diagram showing a unit pixel of an organic light emitting display apparatus according to another exemplary embodiment of the present invention.

FIG. 2 is a circuit diagram showing a unit pixel of an organic light emitting display apparatus according to another exemplary embodiment of the present invention.

As shown in FIG. 2, a driving circuit for driving an organic electroluminescent element (EL) includes a first switching transistor (QS1), a second switching transistor (QS2), a storage capacitor (CST), a first driving transistor (QD1), a second driving transistor (QD2) and an inverter (QI1, QI2), which are disposed in a region defined by a data line (DLn) transferring a data signal therethrough, scan lines (SLn, SLn−1) transferring scan signals therethrough and a bias voltage line (VLn) transferring a bias voltage (VDD) therethrough.

The driving circuit further includes the first driving transistor (QD1), the second driving transistor (QD2) and the inverter (QI1, QI2) compared with the driving circuit of FIG. 1.

The first and the second switching transistors (QS1 and QS2) include amorphous silicon thin film transistors (a-Si TFTs), respectively. The first and second driving transistors (QD1 and QD2) may also include the amorphous silicon thin film transistors, respectively. The amorphous silicon thin film transistors (a-Si TFTs) may include n-channel metal oxide semiconductors (NMOS).

A source electrode of the first switching transistor (QS1) is electrically connected to the data line (DLn), and a gate electrode thereof is electrically connected to the scan line (SLn). The first switching transistor (QS1) outputs the data signal via a drain electrode thereof in response to the scan signal.

A gate electrode of the second switching transistor (QS2) is electrically connected to the scan line (SLn) and the gate electrode of the first switching transistor (QS1), and a source electrode of the second switching transistor (QS2) is electrically connected to a first reference voltage line (VRL1) transferring a first reference voltage (VREF1) therethrough. The second switching transistor (QS2) controls an output of the fist reference voltage (VREF1) in response to the scan signal. The first reference voltage (VREF1) may be provided from an external power source to the organic light emitting display apparatus. Alternatively, a ground voltage or a common voltage (VCOM) may also be used as the first reference voltage (VREF1).

The first end of the storage capacitor (CST) is electrically connected to the drain electrode of the first switching transistor (QS1), and the second end of the storage capacitor (CST) is electrically connected to the drain electrode of the second switching transistor (QS2). The storage capacitor (CST) stores an electric charge formed by the data signal that is provided from the first switching transistor (QS1). In particular, the voltage level of the data signal substantially corresponds to an electric potential difference between the first reference voltage (VREF1) that is provided via the second switching transistor (QS2) and a data voltage signal that is provided via the first switching transistor (QS1). Namely, the data signal corresponds to the electric potential difference between nodes N1 and N2.

The drain electrode of the first driving transistor (QD1) is electrically connected to a bias voltage line (VLn), and the gate electrode thereof is electrically connected to a control line (CLn).

A drain electrode of the second driving transistor (QD2) is electrically connected to the source electrode of the first driving transistor (QD1), a gate electrode of the second driving transistor (QD2) is electrically connected to the first end of the storage capacitor (CST), and a source electrode of the second driving transistor (QD2) is electrically connected to the organic electroluminescent element (EL). Since the voltage of the gate electrode of the second driving transistor (QD2) changes according as the voltage of the source electrode of the second driving transistor (QD2) changes, the gate-source voltage (Vgs) may be maintained. The second driving transistor (QD2) prevents a bias voltage VDD from being applied to the first driving transistor (QD1) in response to the VOUT signal of the inverter (QI1, QI2).

The inverter includes a first transistor (QI1) and a second transistor (QI2). The inverter outputs an inversion signal to the control line (CLn) so as to control the first driving transistor (QD1), thereby turning off the first driving transistor (QD1). The inversion signal corresponds to a scan signal of a previous scan line (SLn−1), and have a low level when the scan signal of the present scan line (SLn) has a high level. The first and second transistors (QI1 and QI2) include amorphous silicon thin film transistors, respectively. The amorphous silicon thin film transistors may be n-channel metal oxide semiconductor (NMOS) transistors.

A source electrode of the first transistor (QI1) is electrically connected to a gate electrode of the first reverse transistor (QI1). A second reference voltage (VREF2) is applied to the source electrode and the gate electrode of the first transistor (QI1). For example, the second reference voltage (VREF2) is a gate-on voltage (Von) having a high level. The drain electrode of the second reverse transistor (QI2) is electrically connected to a previous scan line (SLn−1). The second transistor (QI2) outputs the inversion signal to the control line (CLn) via the source electrode of the second transistor (QI2) when the scan line (SLn) electrically connected to the gate electrode of the second transistor (QI2) is activated by the scan signal.

The organic light emitting display apparatus may include a plurality of pixel regions, a plurality of inverters, a plurality of the data lines and a plurality of the scan lines. The inverter may be formed on each of the pixel regions, which is defined by two data lines adjacent to each other and two scan lines adjacent to each other. Alternatively, one inverter may be electrically connected to each of the scan lines, i.e. one inverters may be commonly coupled to a plurality of unit pixels, so as to simplify a structure of the organic light emitting display apparatus, thereby increasing an aperture ratio of the unit pixel.

When a scan signal having a high level is applied to the scan line (SLn), the first and second switching transistors (QS1 and QS2) are turned on. When the first and second switching transistors (QS1 and QS2) are turned on, the data voltage signal is applied to the gate electrode of the second driving transistor (QD2) via the scan line (SLn).

When the first reference voltage (VREF1) is applied to the source electrode of the second driving transistor (QD2) via the second switching transistor (QD2), an electric charge formed by the gate-source voltage (Vgs), which is an electric potential difference between the data voltage signal and the first reference voltage (VREF1), of the second driving transistor (QD2) is stored in the storage capacitor (CST). Thus, the storage capacitor (CST) provides the organic electroluminescent element (EL) with a current. A level of the current determined by the gate-source voltage (Vgs) of the second driving transistor (QD2). When the current is applied to is the organic electroluminescent element (EL), light is generated.

When the scan signal having a high level is applied to the scan line (SLn), the inverter including the first and second transistors (QI1 and QI2) outputs a low-level inversion signal to the gate electrode of the first driving transistor (QD1).

Since the first driving transistor (QD1) connected to the second driving transistor (QD2) in series is completely turned off, the gate-source voltage (Vgs) of the second driving transistor (QD2), which is a electric potential difference between the data voltage signal and the first reference voltage (VREF1), is stored in the storage capacitor (CST), so that the storage capacitor (CST) provides the organic electroluminescent element with the current for generating the light, thereby displaying an image during a frame.

When the second driving transistor (QD2) is turned on and the gate-source voltage (Vgs) of the second driving transistor (QD2) is charged in the storage capacitor, the gate-source voltage (Vgs) of the second driving transistor (QD2) may not be disturbed by the bias voltage because the inverter (QI1, QI2) turns off the first driving transistor (QD1). Therefore, the gate-source voltage (Vgs) of the second driving transistor (QD2) may be changed in accordance with the variation of the data voltage signal, and the gate-source voltage (Vgs) of the second driving transistor (QD2) is stored in the storage capacitor (CST). The gate-source voltage (Vgs) of the second driving transistor (QD2) determines a channel conductance of the second driving transistor (QD2).

Figure 3:
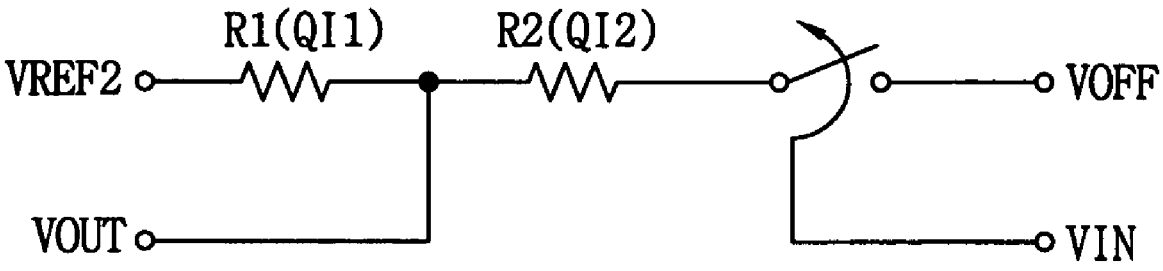
FIG. 3 is a circuit diagram showing an equivalent circuit of an inverter showed in FIG. 2.

FIG. 3 is a circuit diagram showing an equivalent circuit of a inverter showed in FIG. 2.

Referring to FIGS. 2 and 3, when the scan signal (VIN) is applied to the scan line (SLn), the first transistor (QI2) electrically connected to the scan line (SLn) is turned on. An output voltage (VOUT), which corresponds to the inversion signal, of the inverter (QI1, QI2) is determined by the following Equation 1. The second transistor (QI2) functions as a diode.

$$VOUT=VREF2-R1\times(VREF2-VOFF)/(R1+R2) \quad \text{<Equation 1>}$$

R1, R2, VREF2 and VOFF are an equivalent resistance of the first transistor (QI1), a turn-on resistance of the second transistor (QI2), a second reference voltage and a low-level scan voltage, respectively. Sizes of the first and second transistors (QI1 and QI2) may be determined based on the equation 1. Particularly, the sizes of the first and second transistors (QI1 and QI2) are adjusted based on the equation 1 so that the first driving transistor (QD1) may be turned off when the second reference voltage (VREF2) and the low-level scan signal (VOFF) are applied to the inverter. The size of each of the first and second transistors (QI1 and QI2) denotes a channel width/channel length (W/L) ratio.

When a voltage having a low level is applied to the scan line (SLn), the second transistor (QI2) is turned off, and the second reference voltage (VREF2) having a high level is supplied to the gate electrode of the first driving transistor (QD1) via the first transistor (QI1) so that the first driving transistor (QD1) is turned on.

Figure 4:
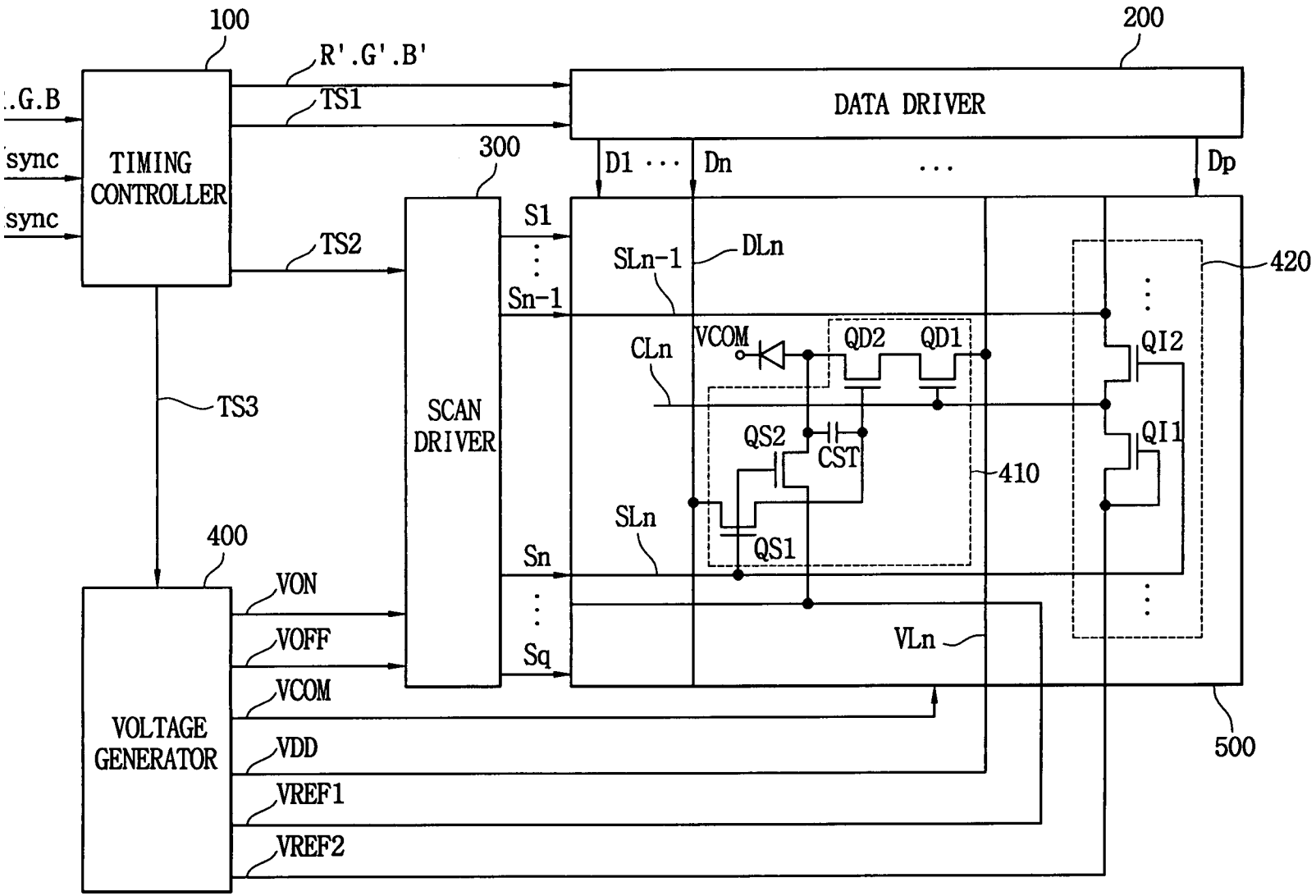
FIG. 4 is a schematic view showing an organic light emitting display apparatus according to an exemplary embodiment of the present invention.

FIG. 4 is a schematic view showing an organic light emitting display apparatus according to an exemplary embodiment of the present invention. The organic light emitting display apparatus includes an active-matrix type organic light emitting display apparatus.

Referring to FIG. 4, the organic light emitting display apparatus includes a timing controller 100, a data driver 200 for receiving an image signal (R'.G'.B') to output a data signal to the data line, a scan driver 300 for receiving a timing signal (TS2) to output a scan signal to the scan line, a voltage generator 400 for outputting an electric source voltage, and an organic light emitting display panel 500 for controlling an amount of a current in response to the data signal to generate light based on the data signal. The voltage generator 400 may output a plurality of the data signals, a plurality of the scan signals and a plurality of the electric source voltages.

The timing controller 100 may receive a plurality of the first image signals (R, G and B) and a plurality of synchronization signals (Vsync and Hsync) from an electronic apparatus such as a graphic controller (not shown). The timing controller 100 outputs a first timing signal (TS1) and second image signals (R'.G'.B') to the data driver 200. In addition, the timing controller 100 outputs a second timing signal (TS2) to the scan driver 300. Furthermore, the timing controller 100 outputs a third timing signal (TS3) to the voltage generator 400.

The data driver 200 receives the second image signals (R', G', B') and the first timing signal (TS1) to output a data signal to the organic light emitting display panel 500. The data driver 200 may output a plurality of the data signals (D1, D2, . . . , Dp). The data signal is a voltage corresponding to a gray-scale voltage.

The scan driver 300 receives the second timing signal (TS2) to output the scan signal to the organic light emitting display panel 500. The scan driver 300 may sequentially output a plurality of the scan signals (S1, S2, S3, . . . , Sq).

The voltage generator 400 receives the third timing signal (TS3). The voltage generator 400 outputs a gate on/off voltage (VON/VOFF) to the scan driver 300 in response to the third timing signal (TS3). In addition, the voltage generator 400 outputs a common voltage (VCOM), a bias voltage (VDD), a first reference voltage (VREF1) and a second reference voltage (VREF2) to the organic light emitting display panel 500.

The organic light emitting display panel 500 may include a plurality of the data lines (DLn), a plurality of the bias voltage lines (VLn), a plurality of the scan lines (SLn), a plurality of the control lines (CLn), a plurality of the organic electroluminescent elements, a plurality of driving circuit 410 and a plurality of the inverters 420. The driving circuit 410 is formed in a region defined by two data lines (DLn, DLn−1) adjacent to each other and two scan lines (SLn, SLn−1) adjacent to each other. The driving circuit 410 may include a plurality of the amorphous silicon thin film transistors. The organic electroluminescent element (EL) is electrically connected to the driving circuit 410. The inverter 420 supplies the control line (CLn) with a inversion signal.

Each of the data lines (DL1, DL2, . . . , DLn) is extended in a longitudinal direction. The data lines are arranged in a horizontal direction. Number of the data lines is indicated by 'p'. The data driver 200 outputs the data signal to the driving circuit 410 via each of the data lines (DL1, DL2, . . . , DLn).

Each of the bias voltage lines (VLn) is extended in the longitudinal direction. The bias voltage lines (VLn) are arranged in the horizontal direction. The voltage generator 400 outputs the bias voltage (VDD) to the driving circuit 410 via each of the bias voltage lines (VLn).

Each of the scan lines (SL1, SL2, . . . , SLn) is extended in the horizontal direction. The scan lines (SL1, SL2, . . . , SLn) are arranged in the longitudinal direction. Number of the scan lines (SLn) is indicated by 'q'. The scan driver 300 outputs the scan signal to the driving circuit 410 via each of the scan lines (SL1, SL2, . . . , SLn).

Each of the control lines (CLn) is extended in the horizontal direction. The control lines (CLn) are arranged in the longitudinal direction. Number of the control lines (CLn) is indicated by 'q'. The inverter 420 outputs the inversion signal to the driving circuit via each of the control lines (CLn).

When a first end of the organic electroluminescent element (EL) is electrically connected to the driving circuit 410, a second end of the organic electroluminescent element (EL) is electrically connected to a common voltage line (VCOM line, not shown) so that the common voltage (VCOM) is applied to the second end of the organic electroluminescent element (EL).

The organic light emitting display apparatus may include a first reference voltage line for transferring the first reference voltage (VREF1) therethrough and a second reference voltage line for transferring the second reference voltage (VREF2) therethrough.

The driving circuit 410 includes two switching transistors (QS1, QS2), one storage capacitor (CST) and two driving transistors (QD1, QD2). The driving circuit 410 shown in FIG. 4 is the same as that shown in FIG. 2. Thus, the same reference numerals will be used to refer to the same or like parts as those described in FIG. 2 and any further explanation will be omitted.

The inverter 420 includes the amorphous silicon thin film transistor to output the inversion signal to the control line (CLn) so as to turn off the driving transistor (QD1) in response to the scan signal. The amorphous silicon thin film transistor may be an n-channel metal oxide semiconductor (NMOS) transistor.

For example, when the organic electro-luminescent display apparatus includes a plurality of the inverters and a plurality of the scan lines, one inverter is electrically connected to each of the scan lines. Alternatively, one inverter may be electrically connected to each of the driving circuits 410.

In addition, the inverter 420 is electrically connected to a first end of the scan line (SLn). The scan signal is applied to a second end of the scan line SLn. Alternatively, the inverter 410 may be electrically connected to the second end of the scan line, to which the scan signal is applied. The scan signal and the inversion signal may be distorted by a resistance-capacitance (RC) delay of the scan line and by an RC delay of the control line, respectively. For example, the amounts of the distortions of the scan signal and the inversion signal may be reduced so that the scan signal and the inversion signal having substantially identical distortion amounts each other may be applied to the driving circuit.

Figure 5:
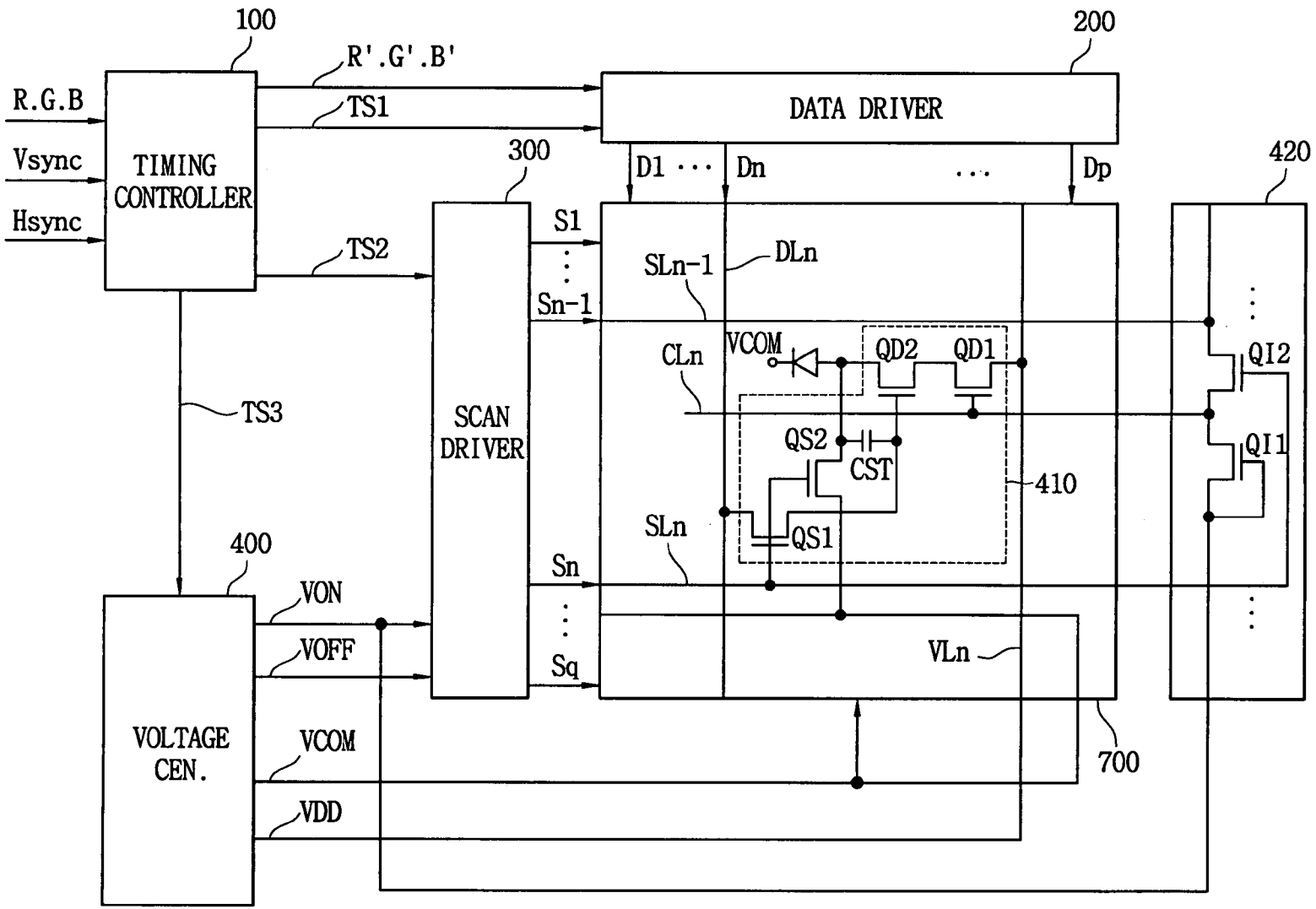
FIG. 5 is a schematic view showing an organic light emitting display apparatus according to another exemplary embodiment of the present invention.

FIG. 5 is a schematic view showing an organic light emitting display apparatus according to another exemplary embodiment of the present invention. The organic electroluminescent display apparatus includes an active-matrix type organic light emitting display apparatus. The organic light emitting display apparatus shown in FIG. 5 is the same as that shown in FIG. 4 except for an inverter. Thus, the same reference numerals will be used to refer to the same or like parts as those described in FIG. 4 and any further explanation will be omitted. For example, the inverter 420 is spaced apart from the organic light emitting display panel 700.

Referring to FIG. 5, an organic light emitting display apparatus includes a timing controller 100, a data driver 200 for receiving an image signal and for outputting a data signal, a scan driver 300 for receiving a timing signal to output a scan signal, a voltage generator 400 for outputting a plurality of the electric source voltages, an inverter 420, and an organic light emitting display panel 700 for controlling an amount of a current in response to the data signal and the scan signal to generate light.

The inverter 420 includes two amorphous silicon thin film transistors. The amorphous silicon thin film transistors may include n-channel metal oxide semiconductor (NMOS) transistors. The inverter 420 outputs inversion signal to a control line (CLn) so as to turn off the driving transistor (QD1) in response to the scan signal.

The first transistor (QI1) of the inverter, which functions as a diode and is electrically connected to the scan line SLn, receives a gate-on voltage (VON) that is applied to the scan driver 300.

The driving circuit 410 includes an amorphous silicon thin film transistor. The organic light emitting display panel 700 may include a plurality of the data lines, a plurality of bias voltage lines, a plurality of the scan lines, a plurality of the control lines, and a plurality of driving circuits 410. The driving circuit 410 may include a plurality of the amorphous silicon thin film transistors. The amorphous silicon thin film transistors are formed in a region defined by two data lines (DLn, DLn−1) adjacent to each other and two scan lines (SLn, SLn−1) adjacent to each other.

Each of the data lines (DLn) is extended in a longitudinal direction. The data lines are arranged in a horizontal direction. Number of the data lines is indicated by 'p'. The data driver 200 outputs the data signal to the driving circuit 410 via each of the data lines (DL1, DL2, . . . , DLn).

Each of the bias voltage lines (VLn) is extended in a longitudinal direction. The bias voltage lines are arranged in a horizontal direction. Number of the bias voltage lines is indicated by 'p'. The voltage generator 400 outputs a bias voltage (VDD) to the driving circuit 410 via the bias voltage lines.

Each of the scan lines (SLn) is extended in a horizontal direction. The scan lines are arranged in the longitudinal direction. Number of the scan lines is indicated by 'q'. Each of the scan lines transfers the scan signal. The scan driver 300 outputs the scan signal to the driving circuit. Each of the control lines (CLn) is extended in the horizontal direction. The control lines are arranged in the longitudinal direction. Number of the control lines is 'q'. Each of the control lines transfers the inversion signal. The inverter 600 outputs the inversion signal to the driving circuit 410.

A second switching transistor (QS2) of the driving circuit 410 includes a gate electrode electrically connected to a gate electrode of a first switching transistor (QS1), a source electrode electrically connected to a common voltage line (VCOM) and a drain electrode. The second switching transistor (QS2) outputs a common voltage (VCOM) via the drain electrode in response to the scan signal.

A first end of the storage capacitor (CST) is electrically connected to a drain electrode of the first switching transistor (QS1), and a second end of the storage capacitor (CST) is electrically connected to the drain electrode of the second switching transistor (QS2). The storage capacitor (CST) stores an electric charge formed by the data signal. The first switching transistor (QS1) applies the data signal to the storage capacitor (CST) during a frame. The data signal corresponds to an electric potential difference between the reference voltage (VCOM), which is provided from the second switching transistor (QS2), and the data voltage signal. A drain electrode of the first driving transistor (QD1) is electrically connected to the bias voltage line (VLn) and a gate electrode of the first driving transistor (QD1) is electrically connected to the control line (CLn).

A drain electrode of the second driving transistor (QD2) is electrically connected to a source electrode of the first driving transistor (QD1). An gate electrode of the second driving transistor (QD2) is electrically connected to the first end of the capacitor (CST), and a source electrode of the second driving transistor (QD2) is electrically connected to the organic electroluminescent element (EL).

Therefore, the first driving transistor (QD1) functions as a switch. Namely, the first driving transistor (QD1) prevents the bias voltage (VDD) from be applied to the second driving transistor (QD2).

According to the present invention, the driving circuit for driving an organic electroluminescent elements includes the amorphous silicon thin film transistors. The amorphous silicon thin film transistors include the n-channel metal oxide semiconductor (NMOS) transistors so that a manufacturing cost of the organic light emitting display panel may be reduced.

In addition, the driving circuit for driving the organic electroluminescent elements supplies the organic electroluminescent elements with the current by controlling the data voltage signal or the bias voltage. Thus, the organic electroluminescent element may employ a conventional drivers, such as the data driver or the scan driver.

Furthermore, the gate-source voltage of the driving transistor may follow the variation of the data voltage signal that is provided from an external image source to the driving circuit.

Although the exemplary embodiments of the present invention have been described, it is understood that the present invention should not be limited to these exemplary embodiments but various changes and modifications may be made by one ordinary skilled in the art within the spirit and scope of the present invention as hereinafter claimed.

What is claimed is:

1. A driving circuit for controlling a current applied to an organic electroluminescent element, the driving circuit comprising:

a first switching element configured to output a data signal supplied from a data line in response to a scan signal supplied from a scan line, the data signal corresponding to a gray scale voltage;

a second switching element configured to output a first reference voltage supplied from a first reference voltage line in response to the scan signal;

a storage capacitor configured to store a first voltage corresponding to a voltage difference between the data signal and the first reference voltage;

a first driving element configure to output a bias voltage supplied from a bias voltage line in response to an inversion signal that has a substantially inverted phase with respect to the scan signal;

a second driving element configured to control a level of the bias voltage based on the first voltage and connected at a node to the organic electroluminescent element to provide the organic electroluminescent element with the current having a level corresponding to the first voltage, wherein the second switching element is directly electrically connected to the node where the second driving element is connected to the organic electroluminescent element; and an inverter for outputting an inversion signal to the control line in response to the scan signal, wherein the inverter comprises first and second transistors.

2. The driving circuit of claim 1, wherein the first driving element is positioned between the bias voltage line and the second driving element.

3. The driving circuit of claim 1, wherein the first switching element, the second switching element, the first driving element and the second driving element each comprise an amorphous silicon thin film transistor.

4. The driving circuit of claim 1, wherein the first switching element, the second switching element, the first driving element and the second driving element each comprise an n-channel MOS (metal oxide semiconductor) transistor.

5. The driving circuit of claim 1, wherein the inverter comprises:

a first transistor for receiving a second reference voltage, the first transistor operating as a diode; and a second transistor for outputting the inversion signal supplied from a previous scan line in response to the scan signal.

6. The driving circuit of claim 5, wherein the inversion signal (VOUT) satisfies the following relationship:

$$VOUT=VREF2-R1\times(VREF2-VOFF)/(R1+R2)$$

R1, R2, VREF2 and VOFF denote an equivalent resistance of the first transistor, an equivalent turn-on resistance of the second transistor, a second reference voltage and a low-level scan voltage, respectively.

7. The driving circuit of claim 5, wherein each of the first and second transistors comprises an amorphous silicon thin film transistor.

8. The driving circuit of claim 5, wherein the first and second transistors each comprise an n-channel MOS (metal oxide semiconductor) transistor.

9. A driving circuit for controlling a current applied to an organic electroluminescent element, the driving circuit comprising:

a first switching element including a first electrode electrically coupled to a data line that transfers a data signal, a second electrode electrically coupled to a scan line that transfers a scan signal and a third electrode, the first switching element outputting the data signal via the third electrode in response to the scan signal;

a second switching element including a fourth electrode and a fifth electrode, the fourth electrode electrically coupled to the scan line and the second electrode of the first switching element, a fifth electrode electrically coupled to a first reference voltage line that transfers the first reference voltage;

a storage capacitor including a first end and a second end, the first end electrically coupled to the third electrode of the first switching element, the second end electrically coupled to the sixth electrode of the second switching element, the storage capacitor storing a first voltage corresponding to a voltage difference between the data signal and the first reference voltage;

a first driving element including a seventh electrode and an eighth electrode, the seventh electrode electrically coupled to a bias voltage line that transfers a bias voltage, the eighth electrode electrically coupled to a control line;

a second driving element including tenth, eleventh and twelfth electrodes, the tenth electrode electrically coupled to the ninth electrode of the first driving element, the eleventh electrode electrically coupled to the first end of the storage capacitor, and the twelfth electrode providing the current to the organic electroluminescent element at a node via the twelfth electrode, the current having a level corresponding to the first voltage, wherein the second switching element is directly electrically connected to the node where the second driving element is connected to the organic electroluminescent element; and an inverter for outputting an inversion signal to the control line in response to the scan signal, wherein the inverter comprises first and second transistors.

10. The driving circuit of claim 9, wherein the first driving element is positioned between the bias voltage line and the second driving element.

11. The driving circuit of claim 9, wherein the inverter comprises:

a first transistor including a thirteenth electrode receiving a second reference voltage and a fourteenth electrode electrically coupled to the thirteenth electrode; and a second transistor including a fifteenth electrode electrically coupled to a previous scan line, a sixteenth electrode electrically coupled to the scan signal and a seventeenth electrode, the second transistor outputting the inversion signal to the control line via the seventeenth electrode in response to the scan signal.

12. The driving circuit of claim 11, wherein each of the first and second transistors comprises an amorphous silicon thin film transistor.

13. The driving circuit of claim 11, wherein the first and second transistors each comprise an n-channel MOS (metal oxide semiconductor) transistor.

14. An organic light emitting display panel comprising:

a data line transferring a data signal corresponding to a gray scale data therethrough;

a bias voltage line transferring a bias voltage therethrough;

a scan line transferring a scan signal therethrough;

a control line transferring an inversion signal having an substantially inverted phase with respect to the scan signal therethrough; and a driving circuit formed in a region defined by the data and scan lines to provide an organic electroluminescent element with a current corresponding to the data signal by controlling a bias voltage in response to the data signal when the scan line is activated, the driving circuit including an amorphous silicon transistor, wherein the driving circuit comprises:

a first switching element configured to be controlled by the scan signal provided from the scan line;

a second switching element configured to be controlled by the scan signal;

a driving element configured to provide an end of the organic electroluminescent element at a node with a bias voltage based on a first reference voltage provided via the second switching element, wherein the second switching element is directly electrically connected to the node where the driving element is connected to the organic electroluminescent element; and an inverter for outputting an inversion signal to the control line in response to the scan signal, wherein the inverter comprises first and second transistors.

15. The organic light emitting display panel of claim 14, wherein the driving element comprises:

a first driving element configured to output the bias voltage in response to the inversion signal; and a second driving element configured to control a level of the bias voltage based on the first voltage to provide the organic electroluminescent element with the current having a level corresponding to the data signal, wherein the first driving element is positioned between the bias voltage line and the second driving element, and the second switching element is directly electrically connected to the node where the driving element is connected to the organic electroluminescent element.

16. The organic light emitting display panel of claim 15, wherein the driving circuit further comprises a storage capacitor configured to store a first voltage corresponding to a voltage difference between the data signal and the first reference voltage.

17. The organic light emitting display panel of claim 15, wherein the first reference voltage line is extended in a direction substantially parallel with the scan line and transfers the first reference voltage therethrough.

18. The organic light emitting display panel of claim 15, wherein the first reference voltage has a ground voltage or a common voltage.

19. The organic light emitting display panel of claim 15, further comprising a second reference voltage line extended in a direction substantially parallel with the scan line to transfer a second reference voltage.

20. The organic tight emitting display panel of claim 15, wherein each of the first and second transistors comprise an n-channel MOS (metal oxide semiconductor) transistor.

21. An organic light emitting display apparatus comprising:

a timing controller configured to output a second image signal and first, second and third timing signals in response to a first image signal and a control signal;

a data driver configured to output a data signal in response to the second image signal and the first timing signal;

a scan driver configured to output a scan signal in response to the second timing signal;

an organic light emitting display panel including a plurality of data lines respectively transferring the data signal, a plurality of scan lines respectively transferring the scan signal, and a plurality of driving circuits respectively formed in a region defined by the data and scan lines, each of the driving circuits including a plurality of amorphous silicon thin film transistors, each of the driving circuits configured to provide an organic electroluminescent element with a current in response to the scan signal by controlling the current based on the data signal and a bias voltage, so that the organic light emitting display panel displays an image; and a power supply configured to output a gate on/off voltage to the scan driver in response to the third timing signal, and configured to output, the bias voltage, a first reference voltage and a second reference voltage to the organic light emitting display panel, wherein the organic light emitting display panel further comprises:

a bias voltage line transferring the bias voltage therethrough;

a control line transferring an inversion signal therethrough, and wherein the driving circuit comprises:

a first switching element including a first electrode electrically coupled to the data line, a second electrode electrically coupled to the scan line, and a third electrode to output the data signal via the third electrode in response to the scan signal;

a second switching element including a fourth electrode electrically coupled to the scan line, a fifth electrode receiving the first reference voltage, and a sixth electrode;

a storage capacitor including a first end electrically coupled to the third electrode of the first switching element and a second end electrically coupled to the sixth electrode of the second switching element, the storage capacitor storing an electric charge formed by the data signal;

a first driving element including a seventh electrode electrically coupled to the bias voltage line, an eighth electrode electrically coupled to the control line, and a ninth electrode;

a second driving element including a tent electrode electrically coupled to the ninth electrode of the first driving element, an eleventh electrode electrically coupled to the first end of the storage capacitor, and a twelfth electrode electrically coupled at a node to the organic electroluminescent element, wherein the second switching element is directly electrically coupled to the node where the second driving element is connected to the organic electroluminescent element; and an inverter for outputting an inversion signal to the control line in response to the scan signal, wherein the inverter comprises first and second transistors.

22. The organic tight emitting display apparatus of claim 21, wherein the first driving element is positioned between the bias voltage line and the second driving element.

23. The organic light emitting display apparatus of claim 21, wherein the inverter is formed in each of the plurality of driving circuits.

24. The organic light emitting display apparatus of claim 21, wherein the scan lines are electrically coupled to the inverter.

25. The organic light emitting display apparatus of claim 21, wherein the inverter is spaced apart from the organic light emitting display panel.

26. The organic light emitting display apparatus of claim 21, wherein the organic tight emitting display panel further comprises a first reference voltage line transferring the first reference voltage therethrough.

27. The organic light emitting display apparatus of claim 26, wherein the organic light emitting display panel further comprises a second reference voltage line transferring the second reference voltage therethrough.

28. The organic tight emitting display apparatus of claim 21, wherein the inverter comprises:

a first transistor including a thirteenth electrode receiving a second reference voltage and a fourteenth electrode electrically coupled to the thirteenth electrode; and a second transistor including a fifteenth electrode electrically coupled to a previous scan line, a sixteenth electrode electrically coupled to the scan signal and a seventeenth electrode, the second transistor outputs the inversion signal to the control line via the seventeenth electrode in response to the scan signal.

* * * * *